US010047324B2

(12) United States Patent
Patel et al.

(10) Patent No.: US 10,047,324 B2
(45) Date of Patent: Aug. 14, 2018

(54) MULTI-STAGE BENEFIT AGENT DELIVERY SYSTEM

(71) Applicant: Henkel IP & Holding GmbH, Düsseldorf (DE)

(72) Inventors: Madhusudan Patel, Old Bridge, NJ (US); Kristen Higgins, Lexington, KY (US); Ryan Bradley Cameron, Newtown, CT (US); Janet Coope-Epstein, Trumbull, CT (US); Maxime Pelletier, Sandy Hook, CT (US); Cynthia L. Moser, Wilton, CT (US)

(73) Assignee: Henkel IP & Holding GmbH (DE)

( * ) Notice: Subject to any disclaimer, the term of this patent is extended or adjusted under 35 U.S.C. 154(b) by 0 days.

(21) Appl. No.: 15/292,686

(22) Filed: Oct. 13, 2016

(65) Prior Publication Data

US 2017/0121648 A1 May 4, 2017

Related U.S. Application Data

(60) Provisional application No. 62/240,836, filed on Oct. 13, 2015.

(51) Int. Cl.

| | |
|---|---|
| ***C11D 3/37*** | (2006.01) |
| ***C11D 3/50*** | (2006.01) |
| ***C11D 11/00*** | (2006.01) |
| ***C11D 3/00*** | (2006.01) |
| ***C11D 3/12*** | (2006.01) |
| ***C11D 17/00*** | (2006.01) |
| ***C11D 3/22*** | (2006.01) |
| ***C11D 3/04*** | (2006.01) |

(52) U.S. Cl.

CPC ..... *C11D 3/505* (2013.01); *C11D 3/001* (2013.01); *C11D 3/046* (2013.01); *C11D 3/1253* (2013.01); *C11D 3/222* (2013.01); *C11D 3/3757* (2013.01); *C11D 11/0017* (2013.01); *C11D 17/0039* (2013.01)

(58) Field of Classification Search

CPC ..... C11D 3/505; C11D 3/373; C11D 17/0039; C11D 3/126; C11D 3/50; C11D 3/1253; C11D 17/003; C11D 3/128

See application file for complete search history.

(56) References Cited

U.S. PATENT DOCUMENTS

| | | | | |
|---|---|---|---|---|
| 9,683,204 | B2 * | 6/2017 | Lock | C11D 3/40 |
| 2005/0227907 | A1 * | 10/2005 | Lee | A61K 8/11 512/4 |
| 2008/0153736 | A1 * | 6/2008 | Elder | A61K 8/06 512/4 |
| 2008/0241201 | A1 * | 10/2008 | Warr | A61K 8/33 424/401 |
| 2010/0286324 | A1 * | 11/2010 | Breton | A61K 8/25 524/446 |
| 2011/0097369 | A1 * | 4/2011 | Sunder | C11D 3/221 424/401 |
| 2011/0104221 | A1 * | 5/2011 | Galeone | A61K 8/06 424/401 |
| 2015/0210957 | A1 * | 7/2015 | Napolitano | C11D 1/83 510/424 |

* cited by examiner

*Primary Examiner* — John R Hardee
(74) *Attorney, Agent, or Firm* — Bojuan Deng

(57) ABSTRACT

The present invention provides a beneficial composition comprising (a) an encapsulated benefit agent composition comprising: a core comprising at least one benefit agent, and a water-insoluble shell; and (b) a suspension medium comprising: at least one suspending polymer, and at least one clay. The present invention also provides methods of using such a beneficial composition. In addition, the present invention provides methods of making a beneficial composition comprising: (a) providing an encapsulated benefit agent composition comprising a core comprising at least one benefit agent and a water-insoluble shell; (b) providing a suspension medium comprising at least one suspending polymer and at least one clay; (c) adding the encapsulated benefit agent composition to the suspension medium; and (d) mixing the suspension medium and the encapsulated benefit agent composition to form a substantially uniform aqueous suspension.

20 Claims, No Drawings

MULTI-STAGE BENEFIT AGENT DELIVERY SYSTEM

BACKGROUND OF THE INVENTION

Field of the Invention

The present invention provides a beneficial composition comprising (a) an encapsulated benefit agent composition comprising: a core comprising at least one benefit agent, and a water-insoluble shell; and (b) a suspension medium comprising: at least one suspending polymer, and at least one clay. The present invention also provides methods of using such a beneficial composition. In addition, the present invention provides methods of making a beneficial composition comprising: (a) providing an encapsulated benefit agent composition comprising a core comprising at least one benefit agent and a water-insoluble shell; (b) providing a suspension medium comprising at least one suspending polymer and at least one clay; (c) adding the encapsulated benefit agent composition to the suspension medium; and (d) mixing the suspension medium and the encapsulated benefit agent composition to form a substantially uniform aqueous suspension.

Background Art

Many home care and personal care formulations seek to deliver benefit agents to substrates such as textiles, hard surfaces, hair, and skin. Encapsulation of the benefit agents in particles has been proposed as a means of enhancing delivery. See WO2014/064122 which is herein incorporated by reference in its entirety. Encapsulated benefit agents are known in the art and many are commercially available. Encapsulation of fragrances has generated particular interest and activity recently.

For many years laundry detergents have been developed to provide long-lasting fragrance to textiles in addition to removal of stains, dirt, soil, grime, and grease. The effective delivery of a fragrance to a washed textile provides an olfactory aesthetic benefit and serves as a signal to consumers that the product is effective.

Effective delivery of a fragrance to a textile during the laundry process is not easy for a variety of reasons. Specifically, fragrances are volatile substances that tend to wash away and/or evaporate during the laundry process. Additionally, surfactants in the wash cycle emulsify the fragrance oils, thereby causing the fragrance oils to be washed down the drain and not deposited onto the fabric.

Conventional approaches to delivering a fragrance to a washed textile include the addition of fragrance to laundry detergents and fabric conditioners in the form of free fragrances, pro-fragrances, and encapsulated fragrances. See e.g., U.S. Pat. No. 6,150,310 ("the '310 patent") and WO1998047996 which are herein incorporated by reference in their entireties. However, laundry detergents supplemented with free fragrance, and most pro-fragrances do not provide effective delivery of a long-lasting fragrance to the textile. Most of the fragrance is washed away during the wash cycle and does not remain on the textile because the fragrance or pro-fragrance is delivered to the wash water at the same time as the cleaning agent.

Encapsulated fragrance particles allows for controlled fragrance release throughout the wash cycle, better retention of fragrance on washed articles, and extended release of retained fragrance post-drying. See generally U.S. Pat. No. 5,066,419 ("the '419 patent") and WO2010084480 which are herein incorporated by reference in their entireties. The '419 patent discloses encapsulated controlled release fragrances for use in cleaners and laundry detergents. WO2010084480 discloses compositions and methods of making encapsulated particles and encapsulated slurries that contain fragrances with controlled permeability characteristics. However, encapsulated fragrance particles in aqueous compositions, e.g., laundry detergents and fabric softeners, require a stable suspension medium to provide a homogenous mixture of the encapsulated fragrance particles. Examples of suspension mediums include thickeners and structurants such as polymers, clays, structuring gums, hydrogenated castor oil, etc. See generally U.S. Pat. No. 7,132,468 ("the '468 patent"), U.S. Pat. No. 7,169,741 ("the '741 patent"), U.S. Patent Application Publication No. 2010/0286324 ("the '324 application"), EP1402877 ("the '877 patent") and EP0869170 ("the '170 patent"), which are herein incorporated by reference in their entireties.

Surfactants (e.g., emulsified cationic surfactants) are used to suspend encapsulated fragrance particles in fabric softeners. See U.S. Pat. No. 5,154,842 ("the '842 patent"), which is herein incorporated by reference in its entirety. The '842 patent provides for fabric softener compositions comprising encapsulated controlled release fragrances. However, suspended encapsulated fragrance particles in cationic fabric softeners are not compatible with the majority of laundry detergents. Similarly, clays have been used to provide stable suspensions in aqueous compositions, e.g., laundry detergents and fabric softeners. See '170 patent. However, the resulting high viscosity decreased dissolution in cold wash water, and reduced dosing efficiency from the dosing cup of clay-thickened aqueous compositions have limited the use of clay-thickened aqueous compositions to the wash step of the laundry process. Thus, there remains a need for compositions that provide a stable suspension for encapsulated fragrance particles without these and other known drawbacks.

Apart from the suspension problems, encapsulated fragrances in aqueous compositions, e.g., laundry detergents and fabric softeners, also have the obvious disadvantage that the consumer does not have the freedom to add fragrance at any step of the laundry process nor to choose the dose and/or scent of the fragrance.

In addition to encapsulated fragrance particles in aqueous compositions, e.g., laundry detergents and fabric softeners, solid forms of encapsulated fragrance particles, e.g., powdered and pastille forms, have also been shown to fragrance textiles. See e.g., U.S. Pat. No. 5,324,444 ("the '444 patent"), U.S. Pat. No. 7,867,968 ("the '968 patent"), U.S. Pat. No. 8,476,219 ("the '219 patent") and U.S. Pat. No. 8,399,395 ("the '395 patent"), which are herein incorporated by reference in their entireties. The '444 patent discloses methods of preparing a powdered encapsulated perfume (herein also interchangeable with the term "fragrance") and compositions for use in laundering textiles. Similarly, the '968 patent discloses compositions of pastilles consisting essentially of high molecular weight polyethylene glycol (PEG), friable perfume microcapsules and free perfume. The '219 patent discloses the process for making the pastilles of the '968 patent. The '395 patent discloses solid fragrance emitting compositions made from a melted matrix (e.g. PEG 8000) into which is incorporated fragrance (free and/or encapsulated) and malodor absorbing compound (β-cyclodextrin). However, due to dissolution limitations, solid encapsulated fragrance particles, e.g., powdered and pastille forms, are effective only when added to the wash step of the laundry process. Thus the limitations associated with solid encapsulated fragrance particles also limit the consumer's overall freedom to add fragrance at any step of the laundry process.

The present invention addresses the drawbacks associated with encapsulated fragrance particles used alone, or in combination with detergents and fabric softeners and provides compositions containing stably suspended encapsulated fragrance that can be employed in the presence of a detergent or softener, added to any stage of the laundry process, and ultimately, provide long-lasting fragrance to laundered textiles.

The present invention also provides a beneficial composition for delivering other benefit agents such as a malodor control agent, a skin benefit agent, a metal chelating agent, a chlorine scavenger, an optical brightener, a cooling agent, an anti-microbial agent, and any mixture thereof.

BRIEF SUMMARY OF THE INVENTION

The present invention provides a beneficial composition, comprising:

(a) an encapsulated benefit agent composition comprising:
  (i) a core comprising at least one benefit agent; and
  (ii) a water-insoluble shell; and
(b) a suspension medium comprising:
  (i) at least one suspending polymer; and
  (ii) at least one clay.

In some embodiments, the beneficial composition is, for example, a liquid, or a gel. In some embodiments, the benefit agent is also in the suspending medium.

In some embodiments, the invention is a beneficial composition, comprising:

(a) an encapsulated benefit agent composition present in an amount from about 0.1 wt % to about 10 wt %; comprising
  (i) a core comprising at least one benefit agent; and
  (ii) a water-insoluble shell; and
(b) a suspension medium comprising:
  (i) at least one suspending polymer present in an amount from about 0.01 wt % to about 2 wt %; and
  (ii) at least one clay present in an amount from about 0.01 wt % to about 2 wt %.

The wt % amounts in the specification refer to the amounts of an active ingredient in the final beneficial composition. For example, the encapsulated fragrance compositions are typically provided by the vendors as aqueous suspensions, typically at about 30 wt % solid encapsulates. The active ingredient refers to the solid encapsulates. In other words, for the encapsulated benefit agent, the wt % amounts in the specification refer to the amount of encapsulate and not the amount of suspension.

In some embodiments, the at least one benefit agent is a fragrance, a malodor control agent, a skin benefit agent, a metal chelating agent, a chlorine scavenger, an optical brightener, a cooling agent, an anti-microbial agent, and any mixture thereof. Examples of benefit agents also include flavours, enzymes, antifoams, fluorescence shading dyes and/or pigments, conditioning agents (for example water-insoluble quaternary ammonium materials and/or silicones), sunscreens, ceramides, antioxidants, reducing agents, sequestrants, colour care additives, density matching polymers, photo-bleaches, lubricants, unsaturated oils, emollients/moisturizer, phase change materials, and mixtures thereof.

In some embodiments, the encapsulated benefit agent composition is a microcapsule, a nanocapsule or any combination thereof.

In some embodiments, the suspension medium further comprises a colorant, a salt, a neutralizing agent, a free fragrance, an emulsifier, or any combination thereof.

In some embodiments, the beneficial composition further comprises a free fragrance, an enzyme, a silicone oil, an anti-re-deposition agent, an optical brightener, a greying inhibitor, a shrink inhibitor, an anti-creasing agent, a color transfer inhibitor, an anti-microbial, a germicide, a fungicide, an anti-oxidant, an anti-static agent, an ironing aid, a water proofing agent, an adsorbent, a swelling agent, an anti-slip agent, a UV absorber, a corrosion inhibitor, or any combination thereof.

The present invention provides a method of making a beneficial composition, comprising:

(a) providing an encapsulated benefit agent composition comprising: a core comprising at least one benefit agent, and a water-insoluble shell;
(b) providing a suspension medium comprising: at least one suspending polymer and at least one clay;
(c) adding the encapsulated benefit agent composition to the suspension medium;
(d) optionally adding a free benefit agent into the suspension medium; and
(e) mixing the suspension medium and the encapsulated benefit agent composition to form a substantially uniform aqueous suspension.

In another embodiment, the present invention provides a method of making a beneficial composition, comprising:

(a) providing a mixture comprising
  (i) an encapsulated benefit agent composition comprising: a core comprising at least one benefit agent, and a water-insoluble shell;
  (ii) at least one suspending polymer;
  (iii) at least one clay; and
  (iv) optionally a free benefit agent; and
(b) mixing the mixture to form a substantially uniform aqueous suspension.

The present invention provides a method of applying a fragrance to a textile, comprising mixing the textile, water, and the beneficial compositions described herein.

The present invention provides a cleaning agent composition, comprising a detergent and the beneficial compositions described herein.

The present invention provides a method of making a cleaning agent composition, comprising combining a detergent or a fabric softener and the beneficial compositions described herein.

DETAILED DESCRIPTION OF THE INVENTION

All of the various aspects, embodiments, and options disclosed herein can be combined in any and all variants unless otherwise specified. Unless defined otherwise, all technical and scientific terms used herein have the same meaning as commonly understood by one of ordinary skill in the art to which this disclosure is related. The headings provided herein are not limitations of the various applications or aspects of the disclosure, which can be had by reference to the specification as a whole. Accordingly, the terms defined immediately below are more fully defined by reference to the specification in its entirety.

As used herein, "a," "an," and "the" include the plural referents unless the context clearly dictates otherwise. The terms "a" or "an," as well as the terms "one or more," and "at least one" can be used interchangeably herein.

As used herein, the term "comprising" means including, made up of, and composed of.

The term "about" as used in connection with a numerical value throughout the specification and the claims denotes an interval of accuracy, familiar and acceptable to a person skilled in the art. In general, such interval of accuracy is ±10%. Thus, "about ten" means 9 to 11. All numbers in this description indicating amounts, ratios of materials, physical properties of materials, and/or use are to be understood as modified by the word "about," except as otherwise explicitly indicated.

The wt % amounts in the specification refer to the amounts of an active ingredient in the final beneficial composition.

Beneficial Compositions

The present disclosure provides beneficial composition providing, for example, to treat a textile and to apply a fragrance to a textile.

In some embodiments, the invention is a beneficial composition comprising:

(a) an encapsulated benefit agent composition comprising:
  (i) a core comprising at least one benefit agent; and
  (ii) a water-insoluble shell; and
(b) a suspension medium comprising:
  (i) at least one suspending polymer; and
  (ii) at least one clay.

Encapsulated Benefit Agent Composition

The term "encapsulated benefit agent composition" as used herein includes, for example, a benefit agent encapsulated within a water-insoluble shell.

Non-limiting examples of benefit agents include a fragrance, a malodor control agent, a skin benefit agent, a metal chelating agent, a chlorine scavenger, an optical brightener, a cooling agent, an anti-microbial agent, and any mixture thereof. Examples of benefit agents also include flavours, enzymes, antifoams, fluorescent shading dyes and/or pigments, conditioning agents (for example water-insoluble quaternary ammonium materials and/or silicones), sunscreens, ceramides, antioxidants, reducing agents, sequestrants, colour care additives, density matching polymers, photo-bleaches, lubricants, unsaturated oils, emollients/moisturizer, phase change materials, and mixtures thereof.

In some embodiments, the shell is coated with a cationic polymer to aid in deposition of the particle onto the fabric. In some embodiments, the at least one benefit agent is a fragrance. In some embodiments, encapsulated fragrance compositions are commercially available from a supplier (e.g., Firmenich, Givaudan, Symrise, International Flavors & Fragrances, Agilex). The encapsulated fragrance compositions are typically provided by the vendors as aqueous suspensions, typically at about 30 wt % solid encapsulates. Examples of water-insoluble shells include melamine-formaldehyde, urea-formaldehyde, and highly hydrolyzed polyvinyl alcohol.

In some embodiments, the encapsulated fragrance composition is a microcapsule, as disclosed in, for example, U.S. Pat. Nos. 8,426,353B2, 6,194,375B1, 6,458,754, 6,056,949, and 6,024,943, and U.S. Patent Application Publication No. 2011/0224127 A1, which are herein incorporated by reference in their entireties. In another embodiment, the encapsulated fragrance composition is a nanocapsule.

In some embodiments, the encapsulated fragrance composition can be a microcapsule, a nanocapsule, or any combination thereof.

In some embodiments, the encapsulated benefit agent composition is present in an amount from about 0.1 wt % to about 10 wt %, from about 0.1 wt % to about 8 wt %, from about 0.1 wt % to about 6 wt %, from about 0.1 wt % to about 4 wt %, and from about 0.1 wt % to about 3 wt %. In some embodiments, the encapsulated benefit agent composition is present in an amount from about 1 wt % to about 5 wt %, from about 1 wt % to about 4 wt %, and from about 1 wt % to about 3 wt %. In some embodiments, the encapsulated benefit agent composition is present in an amount from about 1.5 wt % to about 2.5 wt %, and from about 1.7 wt % to about 2.4 wt %.

Suspending Polymer

In some embodiments, the suspending polymer is selected from the group consisting of a water-soluble polymer, a water-dispersible polymer, and any combination thereof. In some embodiments, the suspending polymer is selected from the group consisting of a hydrophobically-modified alkali swellable emulsion polymer (HASE), an alkali swellable emulsion polymer (ASE), a cationic polymer, an anionic polysaccharide polymer, and any combination thereof.

In some embodiments, the suspending polymer is either a hydrophobically-modified alkali swellable emulsion polymer (HASE), or an alkali soluble emulsion polymer (ASE).

In some embodiments, the hydrophobically-modified alkali swellable emulsion polymer (HASE) is, for example, Carbopol EZ-4, Carbopol EDT 2623, Aculyn 88, Acusol 801S, Rheovis AT-120, or any combination thereof.

In some embodiments, the alkali swellable emulsion polymer (ASE) is, for example, a cross-linked acrylic polymer dispersion, a cross-linked polyacrylate powder, an alkali-swellable anionic acrylic polymer emulsion, a cross-linked acrylic acid homopolymer, or any combination thereof. In some embodiments, the alkali swellable emulsion polymer (ASE) is a cross-linked acrylic polymer dispersion. Examples include Carbopol Aqua 30 from Lubrizol, Acusol 835 from Dow, also from Dow are Acusol 810A, Acusol 842, Polygel W30 from 3V, Novothix L10 from Lubrizol. In some embodiments, the suspending polymer is Carbopol Aqua 30 or Acusol 835.

In some embodiments, the cationic polymer is selected from the group consisting of a polyacrylate-1 crosspolymer, a cationic acrylic polymer, diethylesterdimethylamonium chloride and any combination thereof. In some embodiments, the anionic polysaccharide polymer is selected from the group consisting of guar gum, diutan gum, xanthan gum, and any combination thereof.

In some embodiments, the suspending polymer is present in an amount from about 0.01 wt % to about 2 wt %, from about 0.01 wt % to about 1.5 wt %, from about 0.01 wt % to about 1.0 wt %, and from about 0.01 wt % to about 0.5 wt %. In some embodiments, the suspending polymer is present in an amount from about 0.05 wt % to about 1.5 wt %, from about 0.05 wt % to about 1.0 wt %, and from about 0.05 wt % to about 0.5 wt %. In some embodiments, the suspending polymer is present in an amount from about 0.1 wt % to about 1.0 wt %, from about 0.1 wt % to about 0.8 wt %, from about 0.1 wt % to about 0.6 wt %, from about 0.1 wt % to about 0.4 wt %, from about 0.2 wt % to about 0.4 wt %, from about 0.2 wt % to about 0.5 wt %.

Clay

It has been found that addition of a clay to ASE polymer allows for lower levels of the ASE polymer to be used in providing a stable suspension for various encapsulated fragrance compositions. This results in formulas with lower finished viscosity, thus providing a product with lower residue in the cap. In addition, adding a clay provides the desirable property of minimizing residue when the product is dispensed from the dose cup.

In some embodiments, the clay is capable of providing a fabric softening benefit. In some embodiments, the clay is, for example, a three-layer swellable smectite clay. In some embodiments the smectite clay is, for example, Beidellite clay, Bentonite clay, Hectorite clay, Laponite clay, Montmorillonite clay, Nontronite clay, Saponite clay, Sauconite clay, Veegum clay, or any combination thereof. In some embodiments, the smectite clay is Montmorillonite clay. In some embodiments, the smectite clay is Beidellite clay. In some embodiments, the smectite clay is Laponite clay.

In some embodiments, the clay is present in an amount from about 0.01 wt % to about 2.0 wt %, from about 0.01 wt % to about 1.5 wt %, from about 0.01 wt % to about 1.0 wt %, from about 0.01 wt % to about 0.5 wt %. In some embodiments, the clay is present in an amount from about 0.05 wt % to about 1.0 wt %, from about 0.05 wt % to about 0.8 wt %, from about 0.05 wt % to about 0.6 wt %, from about 0.05 wt % to about 0.5 wt %. In some embodiments, the clay is present in an amount from about 0.1 wt % to about 0.6 wt %, from about 0.1 wt % to about 0.5 wt %, from about 0.1 wt % to about 0.4 wt %, from about 0.2 wt % to about 0.6 wt %, from about 0.2 wt % to about 0.5 wt %, and from about 0.2 wt % to about 0.4 wt %.

Free Fragrance(s)

In some embodiments, the beneficial composition can optionally contain one or more free benefit agents such as free fragrances in the suspension medium. Fragrances are discussed, for example, in U.S. Pat. Nos. 8,119,587B2, 6,869,923 and 7,968,510 which are herein incorporated by reference in their entireties.

In some embodiments, the fragrance is, for example, present in an amount of about 0.2 wt %, about 0.3 wt %, about 0.4 wt %, about 0.5 wt %, about 0.6 wt %, about 0.7 wt %, about 0.8 wt %, about 0.9 wt %, about 1.0 wt %, about 2.0 wt %, about 3.0 wt %, about 4.0 wt %, or about 5.0 wt %. In some embodiments, the fragrance is, for example, present in an amount from about 0.1 wt % to about 5 wt %, from about 0.1 wt % to about 4 wt %, from about 0.1 wt % to about 3 wt %, from about 0.1 wt % to about 2 wt %, or from about 0.1 wt % to about 1 wt %.

In some embodiments, the fragrance is, for example, an ester, an ether, an aldehyde, a ketone, an alcohol, a hydrocarbon, an oil, an essential oil, a botanical, or any combination thereof. In some embodiments, the fragrance is an oil.

In some embodiments, the fragrance is, for example, a musky scent, a putrid scent, a pungent scent, a camphoraceous scent, an ethereal scent, a floral scent, a fruity scent, a peppermint scent, an aromatic scent, a gourmand scent, or any combination thereof.

Other fragrances known in the art, or any fragrance commercially available from a fragrance supplier (e.g. Firmenich, Givaudan, IFF, Symrise, Agilex etc.), or any combination of such fragrances, may also suitably be used in the beneficial compositions and methods disclosed herein.

In some embodiments, the fragrance is fragrance oils.

In some embodiments, the fragrance is combined with an emulsifier.

Colorant(s)

In some embodiments, the beneficial composition further comprises one or more colorants. In some embodiments, the colorant(s) is, for example, polymers, dyes, water-soluble dyes, water-soluble polymeric colorants, pigments, a biological pigment, an ink, paint, or any combination thereof.

In some embodiments, the colorants are, for example, colorants that are well-known in the art or commercially available from dye or chemical manufacturers.

In some embodiments, the colorant(s) is not limited, and can be, for example, red, orange, yellow, blue, indigo, violet, or any combination thereof. In some embodiments, the colorant(s) can be, for example, one or more Milliken LIQUITINT colorants. In some embodiments, the colorant(s) can be, for example Milliken LIQUITINT: VIOLET LS, ROYAL MC, BLUE HP, BLUE MC, AQUAMARINE, GREEN HMC, BRIGHT YELLOW, YELLOW LP, YELLOW BL, BRILLIANT ORANGE, CRIMSON, RED MX, PINK AL, RED BL, RED ST, or any combination thereof.

In some embodiments, the colorant is, for example, present in an amount from about 0.0001 wt % to about 0.01 wt %, from about 0.0002 wt % to about 0.009 wt %, from about 0.0003 wt % to about 0.008 wt %, from about 0.0004 wt % to about 0.007 wt %, from about 0.0005 wt % to about 0.006 wt %, from about 0.0006 wt % to about 0.005 wt %, from about 0.0007 wt % to about 0.004 wt %, from about 0.0008 wt % to about 0.003 wt %, from about 0.0009 wt % to about 0.002 wt %, or from about 0.001 wt % to about 0.0015 wt %. In some embodiments, the colorant is, for example, present in an amount ranging from about 0.001 wt % to about 0.0015 wt %.

In some embodiments, the colorant is, for example, present in an amount of about 0.0001 wt %, about 0.0002 wt %, about 0.0003 wt %, about 0.0004 wt %, about 0.0005 wt %, about 0.0006 wt %, about 0.0007 wt %, about 0.0008 wt %, about 0.0009 wt %, about 0.001 wt %, about 0.0015 wt %, about 0.00125 wt %, about 0.002 wt %, about 0.003 wt %, about 0.004 wt %, about 0.005 wt %, about 0.006 wt %, about 0.007 wt %, about 0.008 wt %, about 0.009 wt %, or about 0.010 wt %. In some embodiments, the colorant is, for example, present in an amount of about 0.001 wt %.

In some embodiments, the colorant is present, for example, in the suspension medium.

Neutralizing Agent

In some embodiments, the beneficial composition further comprises one or more neutralizing agents. In some embodiments, the neutralizing agent is, for example, triethanolamine, sodium hydroxide, potassium hydroxide, monoethanolamine or other neutralizing agents known in the art. In some embodiments, the neutralizing agent is, for example, triethanolamine.

In some embodiments the neutralizing agent is, for example, present in an amount from about 0.001 wt % to about 1 wt %, from about 0.002 wt % to about 0.9 wt %, from about 0.003 wt % to about 0.8 wt %, from about 0.004 wt % to about 0.7 wt %, from about 0.005 wt % to about 0.6 wt %, from about 0.006 wt % to about 0.5 wt %, from about 0.007 wt % to about 0.4 wt %, from about 0.008 wt % to about 0.3 wt %, from about 0.009 wt % to about 0.2 wt %, or from about 0.01 wt % to about 0.15 wt %. In some embodiments, the neutralizing agent is present in an amount from about 0.004 wt % to about 0.7 wt %. In some embodiments, the neutralizing agent is present in an amount from about 0.003 wt % to about 0.8 wt %. In some embodiments, the neutralizing agent is present in an amount from about 0.01 wt % to about 0.15 wt %. In some embodiments, the neutralizing agent is present in an amount from about 0.01 wt % to about 1 wt %, from about 0.01 wt % to about 0.8 wt %, and from about 0.01 wt % to about 0.6 wt %. In some embodiments, the neutralizing agent is present in an amount from about 0.1 wt % to about 1 wt %, from about 0.1 wt % to about 0.8 wt %, from about 0.1 wt % to about 0.6 wt %, and from about 0.1 wt % to about 0.4 wt %.

In some embodiments, the neutralizing agent is, for example, present in an amount of about 0.01 wt %, about 0.02 wt %, about 0.03 wt %, about 0.04 wt %, about 0.05 wt %, about 0.06 wt %, about 0.07 wt %, about 0.08 wt %, about 0.09 wt %, about 0.10 wt %, about 0.11 wt %, about 0.12 wt %, about 0.13 wt %, about 0.14 wt %, about 0.16 wt %, about 0.17 wt %, about 0.18 wt %, about 0.19 wt %, about 0.2 wt %, about 0.3 wt %, about 0.4 wt %, about 0.5 wt %, about 0.6 wt %, about 0.7 wt %, or about 0.8 wt %. In some embodiments, the neutralizing agent is present in an amount of about 0.08 wt %. In some embodiments, the neutralizing agent is present in an amount of about 0.19 wt %. In some embodiments, the neutralizing agent is present in an amount of about 0.75 wt %.

Salt

In some embodiments, salt is used for the purpose of stabilizing the suspending base in the presence of the fragrance encapsulation composition. Certain fragrance composition cores were found to require salt for stabilization. In some embodiments the salt is selected from the group consisting of a water-soluble inorganic alkali metal salt, a water-soluble organic alkali metal salt, a water-soluble inorganic alkaline earth metal salt, a water-soluble organic alkaline earth metal salt, sodium chloride, sodium bromide, sodium iodide, sodium sulfate, sodium bisulfate, sodium phosphate, sodium carbonate, sodium acetate, sodium citrate, sodium lactate, potassium chloride, potassium bromide, potassium iodide, potassium sulfate, potassium bisulfate, potassium phosphate, potassium carbonate, potassium acetate, potassium citrate, potassium lactate, magnesium chloride, magnesium bromide, magnesium iodide, magnesium sulfate, magnesium phosphate, magnesium carbonate, magnesium acetate, magnesium citrate, magnesium lactate, calcium chloride, calcium bromide, calcium iodide, calcium sulfate, calcium phosphate, calcium carbonate, calcium acetate, calcium citrate, calcium lactate, and any combination thereof. In some embodiments, the salt is sodium chloride. In some embodiments, the salt is calcium chloride.

In some embodiments, the salt component is, for example, present in an amount from about 0.001 wt % to about 1 wt %, from about 0.002 wt % to about 0.9 wt %, from about 0.003 wt % to about 0.8 wt %, from about 0.004 wt % to about 0.7 wt %, from about 0.005 wt % to about 0.6 wt %, from about 0.006 wt % to about 0.5 wt %, from about 0.007 wt % to about 0.4 wt %, from about 0.008 wt % to about 0.3 wt %, from about 0.009 wt % to about 0.2 wt %, or from about 0.01 wt % to about 0.15 wt %. In some embodiments, the salt is present in an amount from about 0.004 wt % to about 0.7 wt %. In some embodiments, the salt is present in an amount from about 0.003 wt % to about 0.8 wt %. In some embodiments, the salt is present in an amount from about 0.01 wt % to about 0.15 wt %. In some embodiments, the salt is present in an amount of about 0.04 wt %.

Other Ingredients

In some embodiments, the beneficial composition further comprises other ingredients. In some embodiments, the other ingredients are known to a person of ordinary skill in the art and include a bleaching agent, a bleach activator, a dye-transfer inhibitor, a shading dye, a silicone oil, an anti-re-deposition agent, an optical brightener, a greying inhibitor, a shrink inhibitor, an anti-creasing agent, a color transfer inhibitor, an anti-microbial, a germicide, a fungicide, an anti-oxidant, a metal chelating agent, an anti-static agent, an ironing aid, a water proofing agent, an adsorbent, a swelling agent, an anti-slip agent, a UV absorber, a corrosion inhibitor, an anti-fading agent, a soil release agent, phase-change materials, polysaccharides, a detergent, a fabric softener, pH adjusting agents, pearlescers, opacifiers, viscosity modifiers, enzymes, surfactants, brighteners, preservatives and natural nutrients such as botanicals, fruit extracts, and plant extracts or any combination thereof.

In some embodiments, the beneficial composition further comprises at least one preservative.

In some embodiments, the preservative is, for example, present in an amount from about 0.01 wt % to about 0.2 wt %, from about 0.02 wt % to about 0.19 wt %, from about 0.03 wt % to about 0.18 wt %, from about 0.04 wt % to about 0.17 wt %, from about 0.05 wt % to about 0.165 wt %, from about 0.06 wt % to about 0.16 wt %, from about 0.07 wt % to about 0.155 wt %, from about 0.08 wt % to about 0.15 wt %, from about 0.09 wt % to about 0.145 wt %, from about 0.1 wt % to about 0.15 wt %. In some embodiments, the preservative is present in an amount from about 0.1 wt % to about 0.15 wt %.

In some embodiments, the invention is a beneficial composition, comprising:

(a) an encapsulated benefit agent composition present in an amount from about 0.1 wt % to about 10 wt %; comprising
  (i) a core comprising at least one benefit agent; and
  (ii) a water-insoluble shell; and
(b) a suspension medium comprising:
  (i) at least one suspending polymer present in an amount from about 0.01 wt % to about 2 wt %; and
  (ii) at least one clay present in an amount from about 0.01 wt % to about 2 wt %.

In some embodiments, the invention is a beneficial composition, comprising:

(a) an encapsulated benefit agent composition present in an amount from about 1 wt % to about 5 wt %; comprising
  (i) a core comprising at least one benefit agent; and
  (ii) a water-insoluble shell; and
(b) a suspension medium comprising:
  (i) at least one suspending polymer present in an amount from about 0.05 wt % to about 0.8 wt %; and
  (ii) at least one clay present in an amount from about 0.05 wt % to about 1 wt %.

In some embodiments, the invention is a beneficial composition, comprising:

(a) an encapsulated benefit agent composition present in an amount from about 1 wt % to about 4 wt %; comprising
  (i) a core comprising at least one benefit agent; and
  (ii) a water-insoluble shell; and
(b) a suspension medium comprising:
  (i) at least one suspending polymer present in an amount from about 0.2 wt % to about 0.5 wt %; and
  (ii) at least one clay present in an amount from about 0.2 wt % to about 0.35 wt %.

Methods of Making

In some embodiments, the present invention provides a method of making a beneficial composition, comprising:

(a) providing an encapsulated benefit agent composition comprising a core comprising at least one benefit agent and a water-insoluble shell;
(b) providing a suspension medium comprising at least one suspending polymer and at least one clay;
(c) adding the encapsulated benefit agent composition to the suspension medium;

(d) optionally adding a free benefit agent into the suspension medium; and (e) mixing the suspension medium and the encapsulated benefit agent composition to form a substantially uniform aqueous suspension.

In another embodiment, the present invention provides a method of making a beneficial composition, comprising:

(a) providing a mixture comprising (i) an encapsulated benefit agent composition comprising: a core comprising at least one benefit agent, and a water-insoluble shell;

(ii) at least one suspending polymer;

(iii) at least one clay; and (iv) optionally a free benefit agent; and (b) mixing the mixture to form a substantially uniform aqueous suspension.

In some embodiments, the at least one benefit agent is a fragrance, a malodor control agent, a skin benefit agent, a metal chelating agent, a chlorine scavenger, an optical brightener, a cooling agent, an anti-microbial agent, or any mixture thereof. Examples of benefit agents also include flavours, enzymes, antifoams, fluorescent shading dyes and/or pigments, conditioning agents (for example water-insoluble quaternary ammonium materials and/or silicones), sunscreens, ceramides, antioxidants, reducing agents, sequestrants, colour care additives, density matching polymers, photo-bleaches, lubricants, unsaturated oils, emollients/moisturizer, phase change materials, and mixtures thereof.

In some embodiments, the suspending polymer is for example, a hydrophobically-modified alkali swellable emulsion polymer (HASE), or an alkali swellable emulsion polymer (ASE).

In some embodiments, the hydrophobically-modified alkali swellable emulsion polymer (HASE) is, for example, Carbopol EZ-4, Carbopol EDT 2623, Aculyn 88, Acusol 801S, Rheovis AT-120, or any combination thereof.

In some embodiments, the alkali swellable emulsion polymer (ASE) is, for example, a cross-linked acrylic polymer dispersion, a cross-linked polyacrylate powder, an alkali-swellable anionic acrylic polymer emulsion, a cross-linked acrylic acid homopolymer, or any combination thereof. In some embodiments, the alkali swellable emulsion polymer (ASE) is a cross-linked acrylic polymer dispersion. Examples include Carbopol Aqua 30 from Lubrizol, Acusol 835 from Dow, also from Dow are Acusol 810A, and Acusol 842; Polygel W30 from 3V, and Novothix L10 from Lubrizol. In some embodiments, the suspending polymer is Carbopol Aqua 30 or Acusol 835.

In another embodiment, the clay is selected from the group consisting of Beidellite clay, Bentonite clay, Hectorite clay, Laponite clay, Montmorillonite clay, Nontronite clay, Saponite clay, Sauconite clay and any combination thereof. In some embodiments, the clay is Laponite clay.

In some embodiments, the uniform aqueous suspension of step (e) is mixed with at least one additional component selected from the group consisting of a colorant, a free fragrance, a salt, a neutralizing agent, an emulsifier, a chelant, a defoamer, an enzyme, and any combination thereof.

In some embodiments, the invention is a method for making a cleaning agent composition comprising combining a detergent and the beneficial composition disclosed herein. In some embodiments, the invention is a method for making a cleaning agent composition further comprising adding a fabric conditioner or a fabric softener.

Methods of Use

The present disclosure also provides methods pertaining to the beneficial compositions described herein providing, for example, treatment of a textile, application of a fragrance to a textile, and softening of a textile.

In some embodiments, the invention is a method of treating a textile comprising mixing the textile, water, and the beneficial compositions described herein. In some embodiments, the method of treating a textile further comprises mixing with a detergent, a fabric softener or any combination thereof.

In some embodiments, the invention is a method of applying a fragrance to a textile comprising mixing the textile, water, and the beneficial compositions described herein. In some embodiments, the method of applying a fragrance to a textile further comprises mixing with a detergent, a fabric softener, or any combination thereof.

In some embodiments, the pouring viscosity of the beneficial compositions is, for example, from about 25 cPs to about 3000 cPs, from 50 cPs to 2500 cPs, about 100 cPs to about 2000 cPs, or about 300 cPs to about 1800 cPs. Viscosity is measured at 70° F. using a Brookfield Viscometer model LVDV-II+ using spindles #2 at 12 rpm which is recommended for viscosities below 2500 cPs.

EXAMPLES

Example 1: Preparation of Encapsulated Fragrance Polymer Suspension

Water was added to a beaker and mixed with at least one suspending polymer (Carbopol® Aqua 30) for five minutes at room temperature. A neutralizing agent (triethanolamine) was added to the polymer mixture to achieve a pH of between 7 and 8 and mixed for 10 minutes at room temperature. Encapsulated fragrance (#1 a commercially available melamine formaldehyde encapsulated fragrance from Firmenich or #2 a commercially available melamine formaldehyde encapsulated fragrance from Givaudan) was added to the mixture and mixed for 5 minutes at room temperature. Colorant, free fragrance oil, and preservative were then added to the mixture; and mixed for 5 minutes at room temperature. Viscosity was measured at a temperature of 70° F. using a Brookfield Viscometer model LVDV-II+ using spindles #2 or #3 at 12 rpm. The amounts of each ingredient mixed together (Formula #1 and #2) and measured viscosities are presented in the table below (QA means quantity adjusted to make 100% by weight of the formula):

| Component | Formula #1 Wt % | Formula #2 Wt % |
|---|---|---|
| Water | QA | QA |
| Carbopol ® Aqua 30 | 0.5 | 0.9 |
| Triethanolamine | 0.23 | 0.48 |
| Encapsulated Fragrance #1 | 2.4 | 0 |
| Encapsulated Fragrance #2 | 0 | 1.74 |
| Free Fragrance Oil | 1.70 | 1 |
| Preservative | 0.10 | 0.10 |
| Colorant | 0.001 | 0.001 |
| Viscosity (cPs) | 490 | 2034 |

Example 2: Stability of Encapsulated Fragrance Polymer Suspensions

Encapsulated fragrance polymer suspensions were produced following the protocol of Example 1 and evaluated for stability. Stability was evaluated by visual inspection of samples which were placed into 4 oz. jars and held at fixed temperatures (room temperature, 40° F., 105F, 125° F.) for designated times. Instability was often seen by capsules creaming to the top of the formula, settling to the bottom of the formula or agglomerating. Other instability can be phase splitting, syneresis, or lumping. The formula compositions and stability outcomes are presented in the table below.

Results show that some of the suspending polymers provided stable formulas with the encapsulated fragrances. In addition, certain polymers may require such high concentrations for suspension that the liquid will be outside of a pourable viscosity range. Among the ASE polymers tested, Carbopol Aqua 30 provided stable formulas with both encapsulated fragrances. Some other types of polymers provided stable formulas with one encapsulated fragrance, including Aculyn 88, Aculyn 38, and Aqusol 835.

Example 3: Dose Response of Polymer Concentration on Suspension Stability

Encapsulated fragrance polymer suspension formulas were produced following the protocol of Example 1 with varied polymer amounts (Formulas #3-7) using 1.74% Encapsulated Fragrance #2. Each formula was evaluated for stability and viscosity. Stability was measured following the protocol of Example 2. Viscosity was measured following the protocol of Example 1. The polymer stability and viscosity evaluations for each formula (Formulas #3-7) are presented in the table below. The data shows that when Aqua 30 alone is used as the suspending polymer, a minimum level of polymer of 0.8 wt % is required, which yields a viscosity of 1422 cPs. Lower levels of polymer yielding

| Polymer | Polymer type | Polymer wt % | Encapsulated Fragrance #1 wt % | Encapsulated Fragrance #2 wt % | Free Fragrance wt % | Stability |
|---|---|---|---|---|---|---|
| Carbopol ® Aqua 30 | ASE-type* | 0.5 | 0.87 | 0 | 0.5 | stable |
| | | 0.5 | 0.87 | 0 | 2 | stable |
| | | 0.5 | 2.03 | 0 | 0.5 | stable |
| | | 0.5 | 2.03 | 0 | 2 | stable |
| Carbopol ® Aqua30 | | 0.9 | 0 | 0.87 | 0.5 | stable |
| | | 0.9 | 0 | 0.87 | 2 | stable |
| | | 0.9 | 0 | 2.03 | 0.5 | stable |
| | | 0.9 | 0 | 2.03 | 2 | stable |
| Carbopol ® EZ-4 | HASE-type** | 0.06 | 2.03 | 0 | — | unstable |
| Carbopol ® EDT 2623 | HASE | 0.2 | 0 | 2.03 | — | unstable |
| | | 0.2 | 2.03 | 0 | — | unstable |
| Aculyn 88 | HASE | 0.7 | 0 | 2.03 | — | unstable |
| | | 0.7 | 2.03 | 0 | — | stable |
| Acusol 801S | HASE | 0.45 | 0 | 2.03 | — | unstable |
| | | 0.45 | 2.03 | 0 | — | unstable |
| Rheovis AT-120 | HASE | 1 | 2.03 | 0 | — | unstable |
| Carbopol ® EDT 2691 | ASE | 0.1 | 0 | 2.03 | — | unstable |
| | | 0.1 | 2.03 | 0 | — | unstable |
| Aculyn 38 | ASE | 0.8 | 0 | 2.03 | — | unstable |
| | | 0.8 | 2.03 | 0 | — | stable |
| Acusol 835 | ASE | 0.5 | 8.3 | 0 | — | stable |
| Carbopol ® EZ-2 | ASE | 0.12 | 0 | 2.03 | — | unstable |
| | | 0.12 | 2.03 | 0 | — | unstable |
| Carbopol ® Aqua CC | Cationic poly-acrylate | 0.8 | 0 | 2.03 | — | unstable |
| | | 0.8 | 2.03 | 0 | — | unstable |
| Rheovis CDE | Cationic poly-acrylate | 0.5 | 2.03 | 0 | — | unstable |
| Guar gum 8/22 | Guar gum | 0.5 | 0 | 2.03 | — | unstable |
| | | 0.5 | 2.03 | 0 | — | unstable |
| Kelco-Vis-DG | Diutan gum | 0.15 | 0 | 2.03 | — | stable |
| | | 0.15 | 2.03 | 0 | — | stable |
| Keltrol CT-SFT | Xanthan gum | 0.5 | 0 | 2.03 | — | unstable |
| | | 0.5 | 2.03 | 0 | — | stable |
| Kelzan | Xanthan gum | 0.3 | 0 | 2.03 | — | stable |
| | | 0.3 | 2.03 | 0 | — | stable |
| Kelzan ASX-T | Xanthan gum | 0.3 | 2.03 | 0 | — | unstable |
| Kelzan ST | Xanthan gum | 0.3 | 0 | 2.03 | — | unstable |
| | | 0.3 | 2.03 | 0 | — | stable |
| Attagel 40 | attapul-gite | 1 | 2.03 | 0 | — | unstable |
| Attagel 50 | attapul-gite | 1 | 2.03 | 0 | — | unstable |
| Armasoft DEQ | Cationic fabric softener | 13 | 2.03 | 0 | — | stable |

*ASE-type = cross-linked acrylic polymer.

**HASE type = hydrophobically modified acrylic polymer.

viscosities of 907 cPs or lower is not sufficient to stabilize the encapsulated fragrance particles.

| Formula # | Carbopol ® Aqua 30 wt % | Viscosity (cPs) | Stability |
|---|---|---|---|
| 3 | 0.9 | 2230 | Stable |
| 4 | 0.8 | 1422 | Stable |
| 5 | 0.7 | 907 | Unstable |
| 6 | 0.6 | 507 | Unstable |
| 7 | 0.5 | 242 | Unstable |

Example 4: Preparation of Beneficial Compositions: Benefit of Clay

Beneficial compositions were produced by the following protocol: water was added to a beaker and mixed with clay (Laponite RD) for 10 minutes. ASE polymer (Carbopol® Aqua 30) was added and mixed for five minutes at room temperature. A neutralizing agent (triethanolamine) was added to the polymer mixture and mixed for 10 minutes at room temperature. Encapsulated fragrance was added to the mixture and mixed for 5 minutes at room temperature. Colorant, fragrance oil and preservative were then added to the mixture and mixed for 5 minutes at room temperature.

Viscosity was measured following the protocol of Example 1. Formulas #8, 9, and 10 were comprised of Encapsulated Fragrance (#1 or #2) and clay. The amounts of components mixed together on an active basis (Formulas #8-10) and viscosity evaluations for each formula are presented in the table below (QA means quantity adjusted to make 100% by weight of the formula):

| Component | Formula #8 wt % | Formula #9 wt % | Formula #10 wt % |
|---|---|---|---|
| Water | QA | QA | QA |
| Laponite RD | 0.20 | 0.50 | 0.50 |
| Sodium Chloride | 0.0 | 0.04 | 0.0 |
| Calcium Chloride | 0.0 | 0.0 | 0.04 |
| Carbopol ® Aqua 30 | 0.3 | 0.25 | 0.35 |
| Triethanolamine | 0.187 | 0.08 | 0.75 |
| Encapsulated Fragrance #1 | 2.4 | 0 | 0 |
| Encapsulated Fragrance #2 | 0 | 1.74 | 1.74 |
| Free Fragrance Oil with Emulsifier | 0.49 | 1.0 | 1.0 |
| Preservative | 0.10 | 0.15 | 0.15 |
| Colorant | 0.001 | 0.001 | 0.001 |
| Viscosity (cPs) | 143 | 244 | 692 |
| Stability | stable | stable | stable |

The addition of Laponite to Aqua 30 allows for much lower levels of Aqua 30 to be used in providing a stable suspension. In addition, Laponite provides the desirable property of minimizing residue when the product is dispensed from the dosing cup. Examples 3 and 4 illustrate how Laponite modifies the thickening effect of Aqua 30 polymer to enable stable suspensions at lower product viscosities. For example, Encapsulated Fragrance #2 can be stabilized with the combination of Laponite and Aqua 30 at viscosities of 244 cPs (Formula #9) and 692 cPs (Formula #10); whereas using Aqua 30 alone, the lowest viscosity for a stable product was 1422 cPs (Formula #4). Encapsulated Fragrance #1 suspension was stable at 143 cPs using Laponite and Aqua 30 (Formula #8) compared to 490 cPs with Aqua 30 alone (Formula #1).

Surprisingly, Formulas #8, 9 and 10 prepared with Laponite clay have significantly lower viscosities than those prepared without clay, yet they were stable suspensions. This is because use of Laponite allows for much lower levels of Aqua 30 to be used in providing a stable suspension. In addition, Laponite provides the desirable property of minimizing residue when the product is dispensed from the dosing cup. This lower viscosity translates to better liquid dispensing from the dosing cup as illustrated below in Example 5.

Example 4a. Alternate Method of Preparation

Water was added to a beaker, and mixed with clay, free fragrance oil, and Encapsulated Fragrance #1. The mixture was subjected to high shear mixing (2000 rpm, slotted insert, Ross model HSM-100LCI) for 5 minutes. The mixture was transfer to an overhead mixer. ASE polymer (Carbopol® Aqua 30) was added to the mixture and mixed for five minutes at room temperature. A neutralizing agent (triethanolamine) was added to the mixture to achieve a pH of between 7 and 8 and mixed for 10 minutes at room temperature. Colorant and preservative were then added; and mixed for 5 minutes at room temperature. Viscosity was measured at 70° F. using a Brookfield Viscometer model LVDV-II+ using spindles #2 at 12 rpm which is recommended for viscosities below 2500 cPs. This is a faster method of production that is scalable to a manufacturing setting. Additionally, the final viscosity is within the consumer acceptable range.

| Component | Formula #11 wt % |
|---|---|
| Water | QA |
| Laponite RD | 0.27 |
| Free Fragrance Oil with Emulsifier | 1.7 |
| Encapsulated Fragrance #1 | 2.4 |
| Carbopol ® Aqua 30 | 0.4 |
| Triethanolamine | 0.187 |
| Preservative | 0.15 |
| Colorant | 0.001 |
| Viscosity (cPs) | 1475 |
| Stability | stable |

Example 5: Residue Testing

Formulas #2, 9, and 10 containing Encapsulated Fragrance #2 were made as described in the protocol of Examples 1 and 4, respectively. The residue of each formula was measured by adding 38.4 g of each formula to a dosing cup and dispensing each formula for 10 seconds at room temperature. The amount of remaining residue was weighed. A lesser weight of residual liquid means a cleaner the cup and less waste of the product. The data shows significantly lower residue remaining in the dosing cup from formulas containing a clay (Formulas #9 and 10) compared to that suspended using ASE polymer alone (Formula #2). The residue evaluations for Formulas #2, 9 and 10 are presented in the table below:

| Formula # | Viscosity (cPs) | Residue (g) |
|---|---|---|
| 2 (0.9% ASE polymer alone) | 2034 | 6.3 |
| 9 (0.25% ASE polymer + 0.5% clay) | 244 | 1.7 |
| 10 (0.35% ASE polymer + 0.5% clay) | 692 | 2.6 |

Example 6: Compatibility Testing

Another important characteristic of the beneficial compositions described herein is their compatibility with detergents and fabric conditioners. Consumers like to have the flexibility to dose the beneficial composition in the wash cycle, when mixed with detergent, or in the rinse cycle, with or without fabric conditioner. Example 2 exemplifies the suspending polymers that yielded stable suspensions. Some suspending polymers listed in Example 2 dissolve easily in laundry detergent. However, some suspending polymers do not fully dissolve when mixed with fabric conditioners. The inability of the beneficial composition to fully dissolve when mixed with a fabric conditioner may cause problems with certain types of High Efficiency ("HE") washing machines which have a Venturi system to dose the fabric conditioner. If the composition forms lumps because of incompatibility, it may block the Venturi system and the product may not be dispensed in the washing machine and could lead to clogging of the machine.

Beneficial compositions were made as described in the protocol of Example 4 with different suspending polymers and added with either laundry detergent or fabric conditioner at room temperature to a HE washing machine's Venturi dispensing tray. Water was added until the products were dispensed out of the tray to simulate the washing machine operation. The compatibility of the solution was determined based on visual assessment. The polymer amounts and compatibility assessment for each solution are presented in the table below:

| Polymer | Compatible with Laundry Detergent | Compatible with Fabric Softener |
|---|---|---|
| Carbopol ® Aqua 30 (0.4-0.9%) | Yes | Yes |
| Cellosize QP 100 MH-V (0.5-1.0%) | Yes | No |
| Kelzan (0.3%) | Yes | No |
| Kelco Vis-DG (0.15%) | Yes | No |
| Armasoft DEQ (13%) | No | Yes |
| Carbopol ® EZ-2 (0.12%) | Yes | No |
| Carbopol ® EZ-4 (0.15%) | Yes | No |

The results indicate that anionic polymers like xanthan gum may form lumps when the formula is dosed with fabric conditioner in the HE washing machine's Venturi dispensing tray. This may also be true of some HASE polymers. Without wishing to be bound by any particular theory, some structural features of ASE, HASE type polymers can influence their dissolution properties. Structural features influence ionic charge, molecular weight, degree of hydrophobicity, hydrodynamic volume, and ultimately the solubility of the polymer.

The final viscosity of the liquid also influences the rate of dissolution; the more viscous formulas are more difficult to dissolve. From the list of suspending polymers tested in Example 2, Aqua 30 was compatible when mixed with fabric conditioner, as well as with laundry detergent (Example 6). Liquid formulations suspended by Aqua 30 had good dissolution profile in fabric conditioner even at high viscosity.

The Summary and Abstract sections may set forth one or more but not all exemplary embodiments of the present invention as contemplated by the inventor(s), and thus, are not intended to limit the present invention and the appended claims in any way.

The breadth and scope of the present invention should not be limited by any of the above-described exemplary embodiments, but should be defined only in accordance with the following claims and their equivalents.

All of the various aspects, embodiments, and options described herein can be combined in any and all variations.

All publications, patents, and patent applications mentioned in this specification are herein incorporated by reference to the same extent as if each individual publication, patent, or patent application was specifically and individually indicated to be incorporated by reference.

What is claimed is:

1. A beneficial composition, comprising:

(a) an encapsulated benefit agent composition comprising:

a core comprising at least one benefit agent; and a water-insoluble shell; and (b) a suspension medium comprising:

at least one suspending polymer;

at least one clay; and water;

further having a viscosity from about 100 cPs to about 2000 cPs.

2. The beneficial composition according to claim 1, wherein the at least one benefit agent is a fragrance.

3. The beneficial composition according to claim 1, wherein the suspension medium further comprises a colorant, a salt, a neutralizing agent, a free fragrance, an emulsifier, or any combination thereof.

4. The beneficial composition according to claim 1, wherein the encapsulated benefit agent composition is present in an amount from about 0.1 wt % to about 10 wt %;

wherein the at least one suspending polymer is present in an amount from about 0.01 wt % to about 2 wt %; and wherein the at least one clay is present in an amount from about 0.01 wt % to about 2 wt %.

5. The beneficial composition according to claim 1, wherein the encapsulated benefit agent composition is a microcapsule, a nanocapsule, or any combination thereof.

6. The beneficial composition according to claim 5, wherein the encapsulated benefit agent composition is a microcapsule.

7. The beneficial composition according to claim 1, wherein the suspending polymer is selected from the group consisting of a water-soluble polymer, a water-insoluble polymer, and any combination thereof.

8. The beneficial composition according to claim 7, wherein the suspending polymer is selected from the group consisting of a hydrophobically-modified alkali swellable emulsion polymer (HASE), an alkali swellable emulsion polymer (ASE), a cationic polymer, an anionic polysaccharide polymer, and any combination thereof.

9. The beneficial composition according to claim 8, wherein the alkali swellable emulsion polymer (ASE) is selected from the group consisting of a cross-linked acrylic polymer dispersion, a cross-linked polyacrylate powder, an alkali-swellable anionic acrylic polymer emulsion, a cross-linked acrylic acid homopolymer, and any combination thereof.

10. The beneficial composition according to claim 1, wherein the clay is smectite clay.

11. A cleaning agent composition, comprising a detergent and the beneficial composition according to claim 1.

12. A cleaning agent composition, comprising a fabric softener and the beneficial composition according to claim 1.

13. A method of making a beneficial composition, comprising:

(a) providing an encapsulated benefit agent composition comprising a core comprising at least one benefit agent and a water-insoluble shell;

(b) providing a suspension medium comprising at least one suspending polymer, at least one clay, and water;

(c) adding the encapsulated benefit agent composition to the suspension medium;

(d) optionally adding a free benefit agent into the suspension medium; and (e) mixing the suspension medium and the encapsulated benefit agent composition to form a substantially uniform aqueous suspension.

14. A method of making a beneficial composition, comprising:

(a) providing a mixture comprising (i) an encapsulated benefit agent composition comprising a core comprising at least one benefit agent and a water-insoluble shell;

(ii) at least one suspending polymer;

(iii) at least one clay; and (iv) optionally a benefit agent; and (b) mixing the mixture and water to form a substantially uniform aqueous suspension.

15. The method of making a beneficial composition according to claim 14, wherein the at least one benefit agent is a fragrance.

16. The method of making a beneficial composition according to claim 14, wherein the encapsulated benefit agent composition is present in an amount from about 0.1 wt % to about 10 wt %;

wherein the at least one suspending polymer is present in an amount from about 0.01 wt % to about 2 wt %; and wherein the at least one clay is present in an amount from about 0.01 wt % to about 2 wt %.

17. The method of making a beneficial composition according to claim 14, wherein the encapsulated benefit agent composition is a microcapsule, a nanocapsule, or any combination thereof.

18. The method of making a beneficial composition according to claim 14, wherein the suspending polymer is selected from the group consisting of a water-soluble polymer, a water-insoluble polymer, and any combination thereof.

19. The method of making a beneficial composition according to claim 18, wherein the suspending polymer is selected from the group consisting of a hydrophobically-modified alkali swellable emulsion polymer (HASE), an alkali swellable emulsion polymer (ASE), a cationic polymer, an anionic polysaccharide polymer, and any combination thereof.

20. The method of making a beneficial composition according to claim 14, wherein the clay is smectite clay.

* * * * *